US007654316B2

(12) United States Patent
Telfer

(10) Patent No.: US 7,654,316 B2
(45) Date of Patent: Feb. 2, 2010

(54) DOWNHOLE CONNECTOR

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 258 days.

(21) Appl. No.: 10/574,586

(22) PCT Filed: Oct. 11, 2004

(86) PCT No.: PCT/GB2004/004289

§ 371 (c)(1),
(2), (4) Date: Nov. 8, 2006

(87) PCT Pub. No.: WO2005/040547

PCT Pub. Date: May 6, 2005

(65) Prior Publication Data

US 2007/0261859 A1 Nov. 15, 2007

(30) Foreign Application Priority Data

Oct. 14, 2003 (GB) ..... 0324028.0

(51) Int. Cl.
*E21B 17/00* (2006.01)

(52) U.S. Cl. ..... 166/242.6; 166/380; 166/381; 285/390

(58) Field of Classification Search ..... 166/380, 166/381, 242.1, 242.6; 175/320; 285/390; 411/2, 3, 4, 5; 403/342, 343, 348
See application file for complete search history.

(56) References Cited

U.S. PATENT DOCUMENTS

| | | | | |
|---|---|---|---|---|
| 1,837,639 | A * | 12/1931 | Wickersham | 285/2 |
| 2,885,225 | A * | 5/1959 | Rollins | 285/115 |
| 4,361,188 | A * | 11/1982 | Russell | 166/381 |
| 5,086,843 | A | 2/1992 | Mims et al. | |
| 5,503,187 | A * | 4/1996 | Simmons et al. | 138/89 |
| 6,467,547 | B2 | 10/2002 | Maquire et al. | |
| 2002/0167173 | A1 * | 11/2002 | Griffin et al. | 285/404 |
| 2003/0122373 | A1 | 7/2003 | Hirth et al. | |

FOREIGN PATENT DOCUMENTS

| | | |
|---|---|---|
| DE | 392878 | 3/1924 |
| WO | WO 00/57020 | 9/2000 |

* cited by examiner

*Primary Examiner*—David J Bagnell
*Assistant Examiner*—Sean D Andrish
(74) *Attorney, Agent, or Firm*—Osha • Liang LLP

(57) ABSTRACT

A releasable connector (10) for joining tubular members in a well bore. The connector (10) is a mating screwthread (38, 58) which is terminated on each member by abutting projections (24, 64), operating as a ratchet. This ensures torque is transmitted between the members in a uni-directionally manner so that make-up torque is never applied to the screwheads when torque is applied to the members. A running tool (12) and a method of setting a liner in a well bore is also described which incorporate the connector (10) so that the liner may be part of a drill string and is left cemented in place in the well, after drilling is complete.

13 Claims, 4 Drawing Sheets

DOWNHOLE CONNECTOR

This application claims an international filing date of 11 Oct. 2004, with an application number of PCT/GB2004/004289, and a priority date of 14 Oct. 2003.

The present invention relates to apparatus and method for running and setting apparatus in a well bore and in particular to apparatus and method for setting a liner in a well bore, where the liner is used as part of the drill string and is left cemented in place in the well, after drilling is complete.

In drilling and completing well bores it is typical to insert liner into the well bore. The liner may be inserted through casing and tied back to provide a production string in a pre-drilled well bore. Alternatively the liner may form part of the drill string and be run into the well bore during drilling. When the liner reaches its desired location, any tools such as the drill bit or mud motors may be removed from the string, and cement is typically passed down the liner to fill the annulus between the liner and the well bore or casing wall. The string above the liner is then detached and removed, leaving a cemented liner within the well bore.

Various tools have been developed to releasably attach to the liner. These are generally termed liner running and setting tools. The tools must also allow for torque to be transmitted through the liner when a drill bit is located below the liner. Additionally it has been found advantageous to rotate and reciprocate the liner during cementing to distribute the cement more evenly and thus the tools need to allow for this. Further, some operations now require the ability to 're-stab' i.e. to reconnect to the liner after cementing. This procedure is also advantageous if the tool is used as a connector to other apparatus than liners e.g. packers.

The most basic of these running and setting tools consist of a screw thread on a setting tool connected to the drill string engaging a matching thread on a setting sleeve at the top of the liner. Release is effected by unscrewing the thread when the liner is cemented. For drilling applications, these tools typically have a left hand thread which is releasable by right hand torque. This is because the drill string has joints connected by right hand threads, which are rotated clockwise in use. It was found that setting tools having right hand threads had make-up torque applied to them during drilling and, as a result, when the tool was released, by rotating the drill string anti-clockwise, joints would separate in the string preferentially to release of the liner.

However, as typical setting tools have left hand threads, torque transmitting mechanisms require to be included in the tools to allow the liner to rotate with the drill string and the drill bit. Some tools use spring loaded dogs or collets on the setting tool to engage longitudinal slots on the setting sleeve. These matings allow for relative longitudinal movement between the setting tool and sleeve while circumferentially securing the two together so that torque can be transmitted between both. In this way they may be considered as a clutch since they must be able to be 'declutched' to release the sleeve from the setting tool. The setting tool and sleeve will turn together whether the string is rotated clockwise or anti-clockwise. Due to the mechanisms and moving parts required, a disadvantage of these tools is that debris within the well bore can impede their action, causing the tool to malfunction. A further disadvantage of many of these tools is that to be releasable, a drop ball or bomb must be landed on the tool through the work string. The drop ball, or bomb blocks all or part of the bore of the liner and therefore impedes efficient cementing.

It is therefore an object of at least one embodiment of the present invention to provide a downhole releasable coupling through which torque can be transmitted without make-up torque being applied to screw threads in the coupling.

It is a further object of at least one embodiment of the present invention to provide a drilling liner system for use on a drill string through which torque can be transmitted without make-up torque being applied to screw threads in the coupling.

According to a first aspect of the present invention there is provided a downhole releasable coupling, the coupling comprising a first substantially tubular member having a bore therethrough, a first screw thread around an outer surface thereof, one or more raised portions arranged circumferentially on the outer surface, the raised portions defining a first face surrounding the member and substantially perpendicular to the outer surface, the first face being directed toward the first screw thread, the first face having a plurality of first projections, each first projection having a substantially first straight portion arranged parallel to the bore and a first sloping portion, joining an apex of the first projection to a base of an adjacent projection; and a second tubular member having a bore therethrough, a second screw thread around an inner surface thereof, one or more raised portions arranged circumferentially on an outer surface thereof, the raised portions defining a second face surrounding the member and substantially perpendicular to the outer surface, the second face being at an end of the member, the second face having a plurality of second projections, each second projection having a substantially second straight portion arranged parallel to the bore and a second sloping portion, joining an apex of the second projection to a base of an adjacent projection; wherein the first tubular member slides within the second tubular member, the first and second screw threads mate and on part engagement of the screw threads, the first and second straight portions can meet to thereby transfer torque when a member is rotated in the direction of the screw threads.

The projections may be considered as teeth on a ratchet. In this way opposing teeth abut so that torque is transferred between the members in a uni-directional manner. As the projections meet before the screw threads end, there is no make-up torque applied to the threads. As soon as the direction of rotation is reversed the members move relative to each other and unscrew. This provides rapid release, as there is no make-up torque to overcome before movement can occur.

Preferably the screw threads are right hand screw threads. In this way, torque can be transmitted on rotation of a work string.

Advantageously the screw threads are multiple start threads. Preferably the screw threads are double start screw threads. Preferably also the screw threads are square. Additionally the screw threads may have generous lead in edges so that the coupling can be re-engaged easily.

Preferably the tubular members are initially releasably attached to each other by a shearing means. Preferably the shearing means is by one or more shear pins. The shear pins may be arranged through apertures on the second member and rest in pockets in the outer surface of the first member. Advantageously the apertures and the pockets align when the first and second straight portions abut. The use of shearing means allows a predetermined torque value to be set at which decoupling will occur.

Additionally at least one o-ring may be arranged at either end of the screw thread circumferentially around the tubular member. This prevents the ingress of debris to the thread. Preferably the o-rings are retained in circumferential grooves on the outer surface of the first tubular member.

An embodiment may comprise four raised portions on each tubular member; each face providing two equidistantly spaced projections; four apertures being arranged through the raised portions of the second tubular; shear pins being located through each aperture into four pockets on the outer surface of the first tubular; and an o-ring located into a groove at each end of the screw thread of the first tubular member.

According to a second aspect of the present invention there is provided a drilling liner system comprising a running tool having a substantially cylindrical first body and a first bore therethrough, the first body having an end adapted for connection to a drill string, and a setting sleeve having a substantially cylindrical second body and a second bore therethrough, the second body having an end adapted for connection to a liner, wherein the running tool and the setting sleeve couple via a detachable coupling according to the first aspect.

Preferably the running tool includes the first tubular and the setting sleeve includes the second tubular member.

Preferably the bores align to provide a continuous central bore through the system.

More preferably the screw threads are right hand screw threads. This arrangement allows torque to be transmitted by rotation of the drill string. Further the system can be reciprocated and rotated as it will simply follow the motion of the drill string until the setting sleeve is held in a fixed position.

Preferably the running tool includes one or more first radial outlets arranged circumferentially around the first body, the setting sleeve includes one or more second radial outlets arranged circumferentially around the second body, and in a first position the first and second radial outlets are aligned and fluid can pass radially from the system. Alignment is effected by moving the running tool and setting sleeve relative to each other by rotation of one against the other to relocate on the screw thread. This provides selective radial fluid flow from the tool which can be used to distribute cement more effectively and wash out the well bore.

Preferably there are four radial ports in each body. More preferably the first position occurs when the first and second screw threads are partially engaged.

Optionally the system may further comprise a seal stem, the stem having a substantially cylindrical third body with a third bore therethrough, a third screw thread on an outer surface thereof for engagement to the second screw thread, and a polished end distal to the screw thread. Once the running tool is decoupled from the setting sleeve, the stem can be connected to the setting sleeve to provide a polished bore receptacle to the setting sleeve for tie-back purposes.

According to a third aspect of the present invention, there is provided a method of setting a liner in a well bore, the method comprising the steps;

(a) providing a drilling liner system according to the second aspect;
(b) connecting the running tool and setting sleeve by engaging the screw threads until the first and second straight portions meet;
(c) connecting the running tool to a drill string and the setting sleeve to a liner;
(d) transmitting torque to the liner by rotating the drill string in a first direction;
(e) cementing the liner in place by introducing cement slurry axially into the bore, to allow the slurry to exit the liner and locate between the liner and the well bore; and
(f) rotating the drill string in a reverse direction until the screw threads disengage; and
(g) removing the running tool from the well bore.

Preferably the first direction is right hand rotation.

The method may include the step of removing an assembly from the well bore through the liner when the system is connected to the liner. The assembly may be a drilling assembly or a mud motor assembly.

Preferably the method includes the step of shearing the shearing means when the drill string is rotated in the reverse direction.

Preferably also the method includes the step of aligning the radial ports to expel fluid or cement from the system.

Preferably the method includes the step of rotating and reciprocating the system on the drill string during cementing.

Preferably the method includes the following steps:

(a) following rotation in the first direction, noting a first circulation pressure in the well bore;
(b) applying liner weight to bottom of well and partly releasing the running tool from the setting sleeve to shear the shear screws and align the radial ports;
(c) confirming that circulation pressure has dropped from the first circulation pressure;
(d) on pressure loss rotating the drill string until the straight portions meet; and
(e) confirming circulation pressure has returned to first circulation pressure.

These steps provide confirmation that, firstly, partial release has occurred and, secondly, that the running tool can be released after cementing.

Embodiments of the present invention will now be given, by way of example only, with reference to the accompanying Figures of which:

Figure 1A:
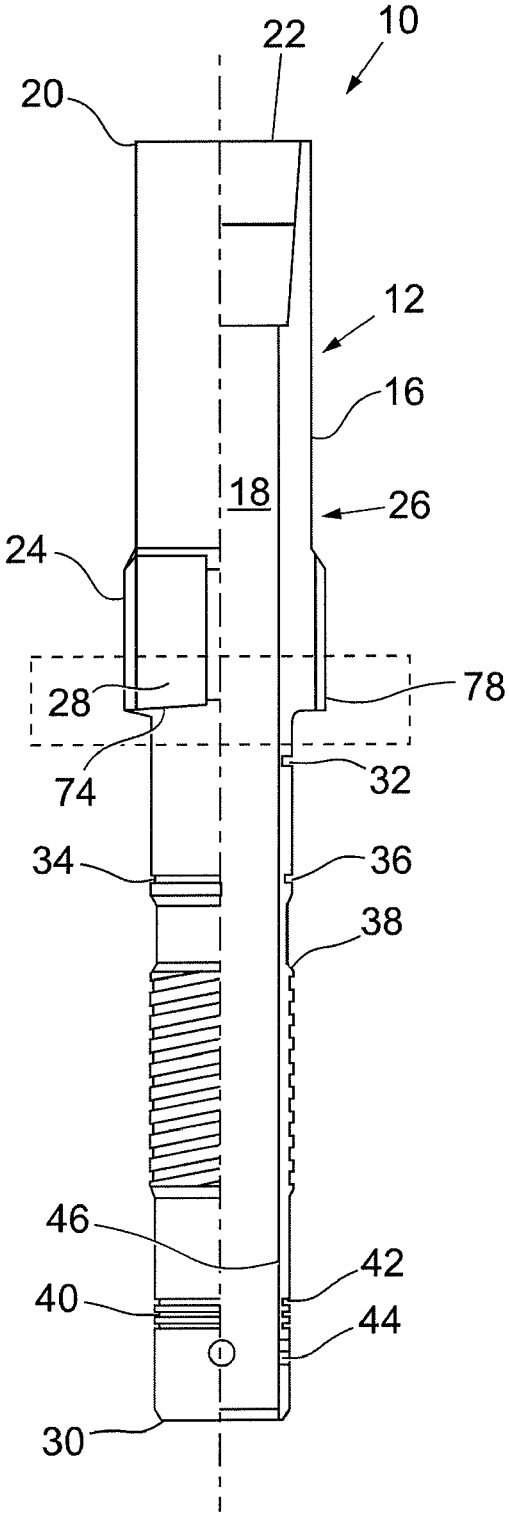
FIG. 1 is a part cross-section of the view of the downhole connector according to an embodiment of the present invention where FIG. 1(*a*) illustrates the first tubular member and FIG. 1(*b*) illustrates the second tubular member to be coupled thereto.
Figure 1B:
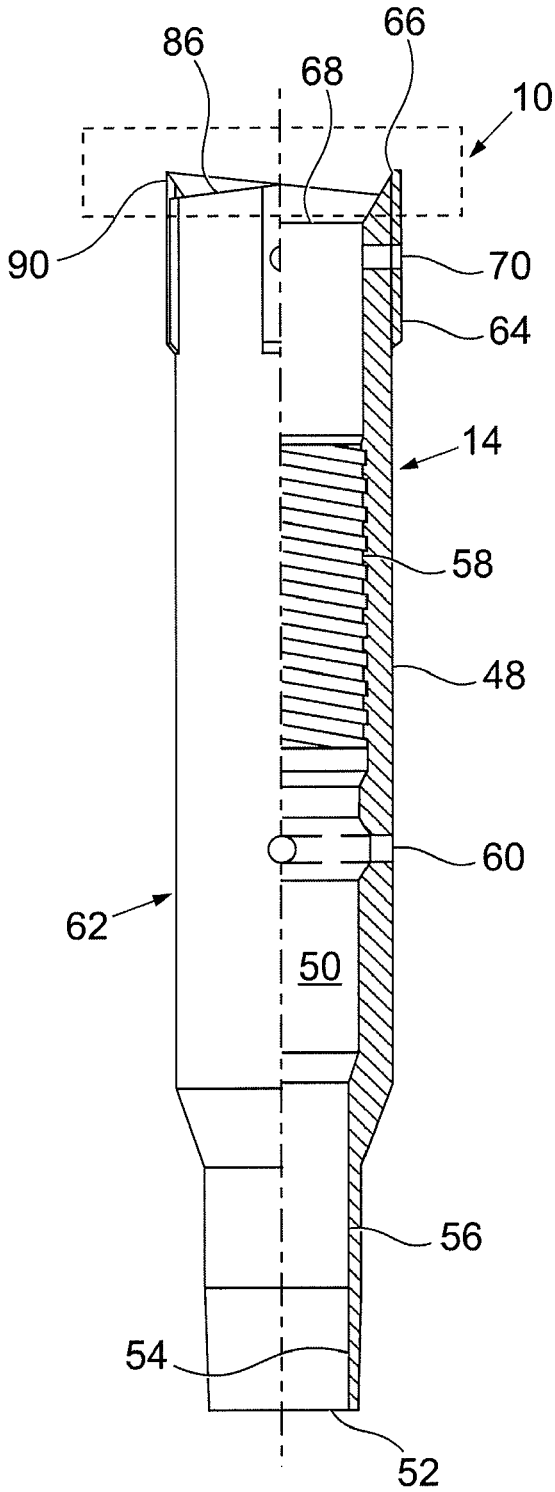

Referring initially to FIG. 1 of the drawings, there is provided a releasable coupling, generally indicated by reference number 10, according to a first embodiment of the present invention. Coupling 10 comprises two parts, the first part being an upper tubular member 12 (e.g., a drilling liner running tool) and the second being a lower tubular member 14 (e.g., a drilling liner setting sleeve) shown in FIGS. 1(*a*) and (*b*) respectively. The upper 12 and lower 14 tubular members are releasably coupled as described hereinafter.

The upper tubular member 12 comprises a cylindrical body 16 and central bore 18 therethrough. At the upper end 20 is located a downhole attachment 22 for connecting the tubular member 12 to a tool or workstring located above. Typically downhole attachment 22 would be a box section as is commonly known in the art. Toward the upper end 20 of tubular member 12 is provided a raised portion 24 on the outer surface 26 of the tubular member 12. Raised portion 24 comprises four substantially longitudinal sections 28 lying longitudinally on the outer surface 26. Longitudinal portions 28 are arranged circumferentially around the body 16.

Working towards a lower end 30 of the member 12 there is next located pockets 32. In the embodiment shown there are four pockets 32 arranged circumferentially on the outer surface 26 of the body 16. Pockets 32 are recesses into which shear screws (not shown) may engage. Below the pockets 32 lies an annular groove 34 into which an O-ring 36 is located. Groove 34 preferably has edges which taper towards the bore 18. The O-ring 36 seals a screw portion 38 of the member 12 from the downhole environment in use.

Screw portion 38 is a double start screw thread formed on the outer surface 26 of the body 16. The screw thread is a square screw thread and is a right hand screw thread. Below the screw portion 38 lies three annular grooves 40 into which three further seals in the form of O-rings 42 locate. O-rings 42 provide the same advantages as O-rings 36 and together they can seal off the screw thread portion 38.

Finally, below the grooves 40 are located radial ports 44. Four radial ports 44 are arranged circumferentially around the body 16 of the member 12. Each port 44 provides a connection from the bore 18 of the member through the wall 46 of the member 12 to the outer surface 26.

Lower tubular member 14 comprises a cylindrical body 48 having an internal bore 50 therethrough. At a lower end 52 of the member 14 is arranged a downhole attachment 54 to couple the member 14 to a tool or workstring arranged below the member 14. It will be understood that attachment 54 will typically be a pin section as is known in the art.

In bore 50 is arranged an inner surface 56. Inner surface 56 comprises a screw thread portion 58 whose threads match and co-operate with the screw thread portion 38 of tubular member 12. In addition, four radial ports 60 are arranged circumferentially on the inner surface 56 to provide a passage for fluid from the bore 50 to the outer surface 62 of the member 14. There are four radial ports 60 arranged circumferentially around the body 48.

On the outer surface 62 of the member 14 are located four raised portions 64. The raised portions 64 are arranged circumferentially on the body 48. Upper ends 66 of the raised portions extend beyond the upper end 68 of the member 14. Arranged on each raised portion 64 is an aperture 70. Aperture 70 provides a connection from the outer surface 62 to the inner surface 56 of the body 48. Aperture 70 is used to fit a shear screw (not shown) through to the pocket 32 of the member 12. It will be appreciated that any number of aperture/pocket combinations can be used and that the selection of the shear screw size and material, together with the number used will determine the torque which can be applied between the upper 12 and lower 14 tubular members to effect a decoupling.

Figure 2A:
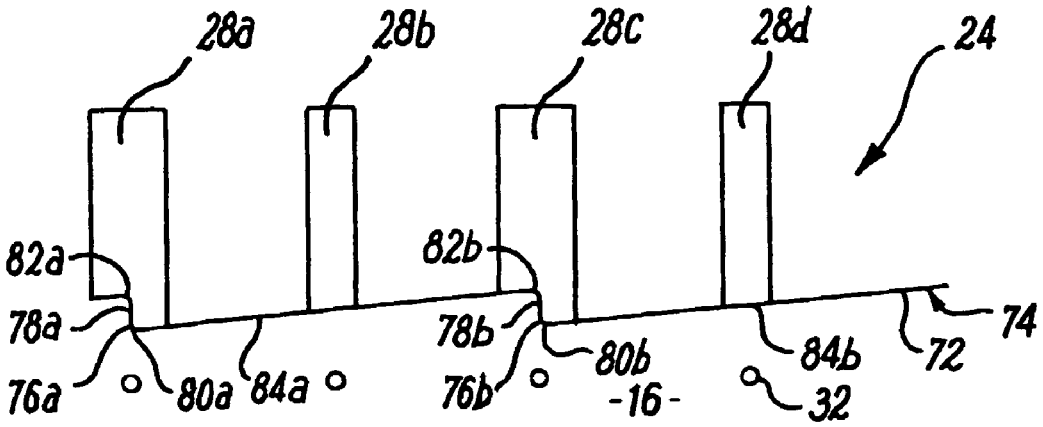
FIG. 2 is a schematic representation of the circumferential profile of a portion of the connector of FIG. 1.
Figure 2B:
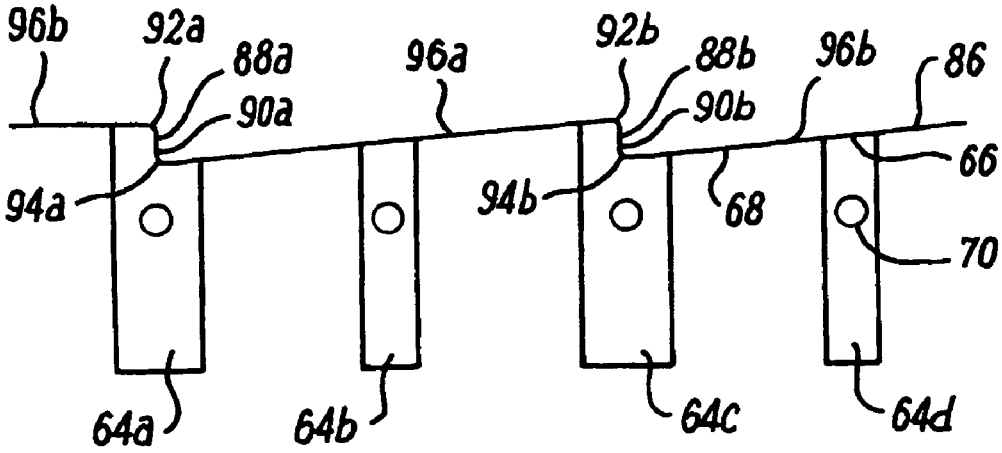

Reference is now made to FIG. 2 of the drawings which provides in two parts, (a) and (b), the raised portions 24, 64 of the tubular members 12 and 14 respectively. FIG. 2(*a*) illustrates the raised portion 24 in longitudinal profile which may be described as a developed circumference. The four longitudinal portions 28*a-d* provide an edge 72 which faces the pockets 32 on the body 16. Edge 72 can be considered as providing a face 74 perpendicular to the outer surface 26 of the member 12. Face 74 includes two projections 76*a,b*. Each projection has a straight portion 78*a,b* which lies longitudinally with the portions 28 and parallel with the bore 18. Each straight portion 78 arrives at an apex 80*a,b* from a base 82*a,b*. Accordingly there are two sloping sections 84*a,b* which join the apexes 80*a,b* to the bases 82*a,b*. It will noted that in this embodiment there are two projections 76*a,b* originating on two portions 28. It will be appreciated however, that any number of raised portions will be designed into the coupling 10.

Referring now to FIG. 2(*b*), there is shown the upper end 68 of member 14 having a complimentary matching face 86 to that of face 74. Face 86 comprises two projections 88*a,b*. The projections each have a straight portion 90*a,b* arranged parallel to the bore 50. Each straight section 90*a,b* also comprises an apex 92*a,b* and a base 94*a,b*. Again adjacent projections 88*a,b* are joined by a sloping surface 96*a,b* which connect the adjoining apexes 92*a,b* with bases 94*a,b*.

Figures 3A, 3B, 3C:
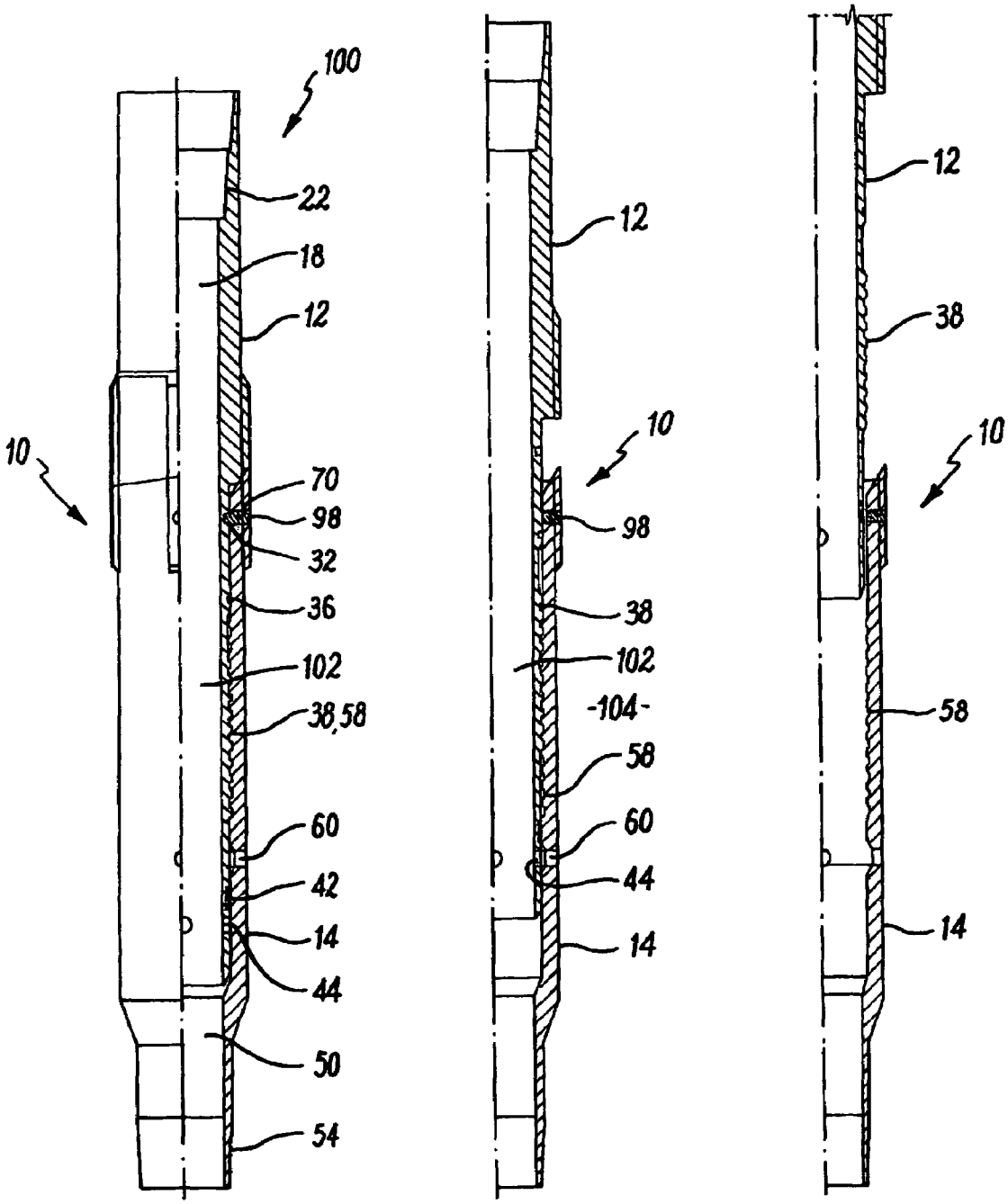
FIG. 3 is a schematic representation of a drilling liner system according to an embodiment of the present invention, illustrated in (a) run in position, (b) partial release or by-pass position and (c) released position.

Reference is now made to FIG. 3 of the drawings which illustrates in the three steps, shown as (a), (b) and (c), the tool in use. In this embodiment the tool is described with reference to a drilling liner system with a coupling 10 being part of a drill string (not shown).

Like parts to those of FIGS. 1 and 2 have been given the same reference numerals to aid clarity. Thus in use, referring initially to FIG. 3(*a*), coupling 10 is in a made-up configuration. This will be the configuration used on run in of a drilling liner system, generally indicated by reference numeral 100, into a well bore (not shown). The upper tubular member 12 will now be recognised as a liner running tool while the lower tubular member will be recognised as a liner setting sleeve.

In this configuration the upper tubular member 12 is connected to an upper section of drill string by use of the box section 22 and the lower tubular member 14 is connected to a lower portion of drill string through the pin section at 54. The tubular members 12, 14 are connected by inserting upper tubular member 12 into lower tubular member 14 and engaging the screw threads 38, 58. The threads are fully engaged until such point that the straight portions 78, 90 abut and prevent any further rotational movement of one tubular member independent of the other tubular member. Thus any torque applied to the upper tubular member 12 in a clockwise direction will cause the lower tubular member 14 to rotate with the upper tubular member 12. In this way torque is transmitted through the system 100.

The upper and lower tubular members 12, 14 are further secured via shear screws 98, located through the aperture 70 of the lower tubular member 14 and into a pocket 32 of the upper tubular member 12. It will be appreciated that the shear screws 98 can be selected to predetermine the torque applied to the coupling 10 at which they will shear and detach the coupling 10 as described hereinafter.

It should noted that a clear bore 102 is provided through the system 100, as a passage from bore 18 through bore 50. Additionally seals 36, 42 isolate the screw threads 38, 58 from the passage of fluid through the bore 102. Fluid in the drill string will pass through the bore 102 as the radial ports 44,60 in each tubular member 12, 14 respectively are misaligned. Thus while the drill string is rotated in a typical clockwise direction the coupling 10 is attached and the drill liner system 100 will act as if part of the drill string, transferring torque to any components or tools attached below the system 100.

As shown in FIG. 3(*b*) to detach the system the upper tubular member 12 is rotated anti-clockwise. While it is known that rotating the drill string in an anti-clockwise direction risks releasing tubing joints within the drill string, these tubing joints will naturally have made-up torque applied to them. By virtue of the straight portions 78, 90 meeting on the upper and lower tubular members 12, 14, torque is transferred through these surfaces and thus there is no made-up torque on the threads and any anti-clockwise rotation will immediately release the faces 78, 90 from each other. Continuous turning of the upper tubular member 12 will cause the screw threads 38, 58 to unscrew and thereby move the upper tubular member 12 away from lower tubular member 14.

On turning the drill string anti-clockwise it is the shear screws 98 will shear at a predetermined torque and the coupling 10 will detach. As the shear screws 98 shear, the straight portions 78, 90 will come away from each other and by virtue of the screw threads, the tubular members are unscrewed from each other.

In the preferred embodiment, as shown in FIG. 3(*b*), anti-clockwise rotation of the upper member 12 relative to the lower member 14 by only two turns causes the radial ports 44, 60 to become aligned. In aligning the radial ports 44, 60 fluid flow can pass from the bore 102 to the annulus 104 outside the system 100. Such movement of fluid will cause a change in fluid pressure at the top of the well bore which can be noted by the operators. Notification of such a pressure change informs the operators that the coupling 10 has detached successfully. At this point fluid could be pumped down the bore 102 to be expelled through the radial ports 44, 60 to provide for a cementing or cleaning action within the annulus 104.

Further rotation of the upper tubular member 12 relative to the lower tubular member 14 in the anti-clockwise direction will eventually cause the screw threads 38, 58 to be completely released from each other and accordingly the upper tubular member 12 becomes entirely detached from the lower tubular member 14. In this configuration the lower tubular member 14 may be left within a well bore, while the upper tubular member 12 can be removed from the well bore upon the drill string.

It should also be noted that simply by reinserting the upper tubular member 12 into the lower tubular member 14 the coupling 10 can be reattached as the threads 38 have a long lead into the threads 58. Thus rotation of the drill string, including the upper tubular 12 into the lower tubular member 14 will cause the coupling to be reattached. The reattachment can be made up to the point where the sloping surfaces 78, 90 meeting. In this configuration the lower tubular member 14 may also be removed from the well bore.

The embodiment described in FIG. 3 is ideally suited to be used for setting a liner in a well bore. The method of setting such a liner in a well bore would be to run a liner with a desired bottom hole assembly. Connect the drilling line system 100 to the drill pipe and run in the well bore on the drill pipe. The bottom hole assembly would include the necessary drill bit and drilling assembly and thus by rotation of the upper tubular member 12 transferring torque to the lower tubular member 14, the hole may be drilled by rotation of the drill string. This is achieved by right hand rotation as required.

With the bottom hole assembly of the bottom of the well, fluid is circulated at a fixed rate, such as 5 bbls/min and the circulation pressure noted. At this point the mudpumps within the well are stopped. If the drill bit and the drilling assembly is to be retrieved with the mud motor, these portions can be fed through the bore 102 to the surface, typically by insertion of a wire line through the bore 102. Next the entire liner weight is applied to the bottom of the well in order to achieve the neutral point of the drilling liner system 100. Such a neutral point allows the drill string to be rotated in a left hand rotation in order that the shear screws shear and the ports 44, 60 align. This occurs by rotation of two left hand rotations on the drill pipe.

In this partially engaged position, shown in FIG. 3(*b*), circulation is restarted at the previous flow rate and the circulation pressure will now be reduced to indicate that the ports 44, 60 have aligned. The system 100 is open to allow fluid to pass between the bore 102 and the annulus 104. This reduction in circulation pressure further shows that partial release has occurred and indicates that the coupling 10 can be released after cementing.

When the pressure loss is noted, the mud pumps are stopped and the upper and lower members 12, 14 are re-engaged by applying two right hand rotations to the system 100. Confirmation that the ports 44, 60 are now closed by being misaligned is confirmed by re-establishing the previous circulation rate and confirming that the pressure has returned to the first pressure noted.

Cementation of the liner can now be performed by injecting cement through the bore 102. It should be noted that the system 100 can be advantageously reciprocated and/or rotated so that the liner can be reciprocated and/or rotated during the cementing process to enhance the cementing operation. A displacement wiper-plug is then launched through the bore 102 to displace cement through the centre of the bore 102.

The entire liner weight is then re-applied to the bottom and eight left hand rotations are applied to the coupling 10. This releases the upper tubular member 12 from the lower tubular member 14 and the upper tubular member is pulled clear of the lower tubular member and returned to the surface. Reverse circulation can be used to remove excess cement as required prior to the string being pulled out of the hole.

Figure 4:
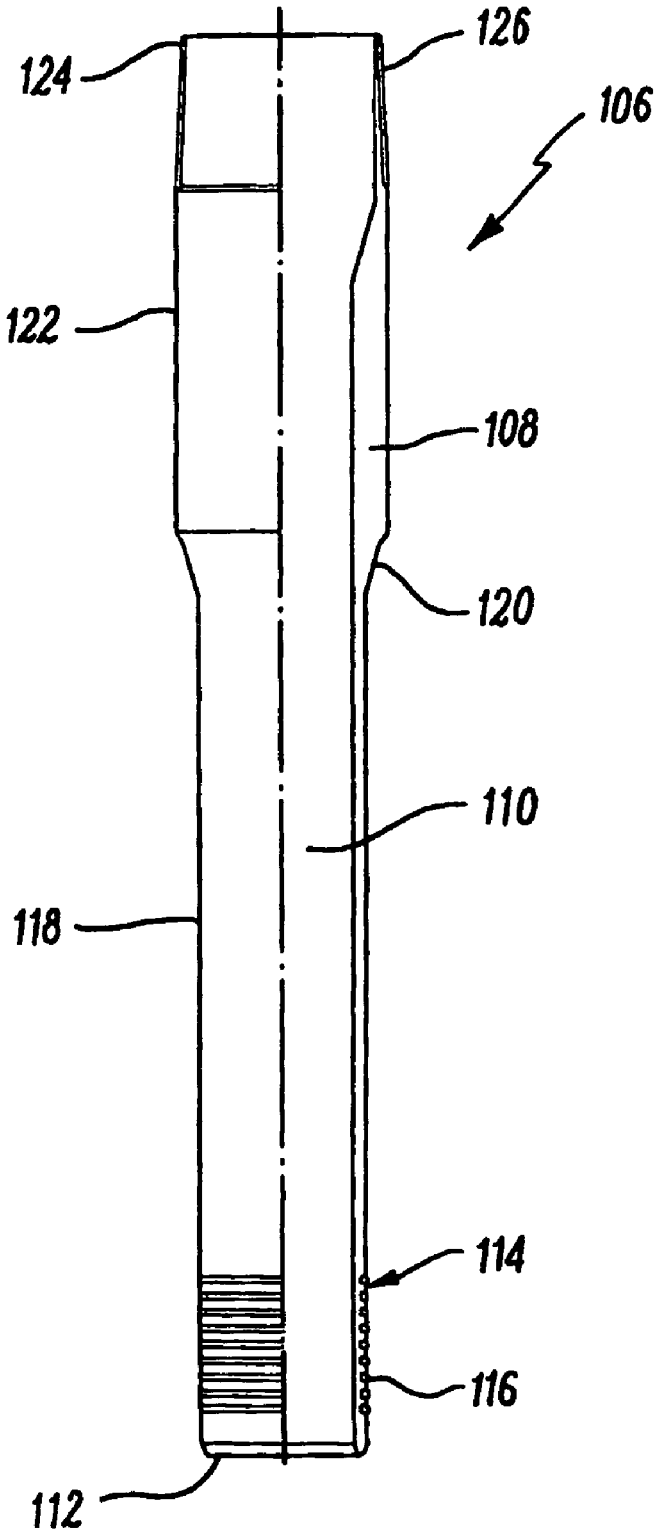
FIG. 4 is a part cross-sectional view of a liner stem for use in the drilling liner system of FIG. 3.

A further feature of the embodiment herein described, is that of the provision of a liner seal stem if required. FIG. 4 shows a suitable liner seal stem, generally indicated by reference numeral 106, which may be used with the liner system 100 described hereinbefore.

The seal stem 106 comprises a cylindrical body 108 having a bore 110 therethrough. At a base 112 of the stem 106 are located annular grooves 114 into which O-ring seals 116 are incorporated. The outer diameter 118 of a lower portion of the stem 106 is sized such that it can fit within the bore 50 of the lower tubular member 14.

When inserted into the lower tubular member 14 the O-rings 116 will seal against the inner surface 56 of the member 14, just below the radial port 60. Sloping portions 120 on the outer surface 118 will meet with the face 74 at the upper end 68 of the member 14. This will provide an upper section 122 of the stem 106 at whose distal end 124 is located a polished bore receptacle 126.

Thus when the stem 106 is inserted in the lower tubular member 14, i.e. the setting sleeve, for the drilling liner system 100 the stem 106 will provide a polished bore receptacle 126 above the cemented liner.

Various modifications made by made to the invention herein described without departing from the scope thereof. For example, the number of projections located on each of the tubular members may be varied as long as it is noted that a substantial meeting of the straight portions will occur on rotation of the two members relative to each other. Further additional seals may be provided around the radial ports to further prevent the ingress of fluids to the screw threads in use. Additionally while the system has primarily described the use of the tool for cementing purposed it will be recognised that the alignment of the radial ports provides a passage both for cement and for cleaning fluid from the central bore to the annulus and indeed walls or casing within a well bore.

The invention claimed is:

1. A drilling liner system comprising a running tool having a substantially cylindrical first body and a first bore therethrough, the first body having an end adapted for connection to a drill string, and a setting sleeve having a substantially cylindrical second body and a second bore therethrough, the second body having an end adapted for connection to a liner, wherein the running tool and the setting sleeve couple via a detachable coupling comprising a first substantially tubular member having a bore therethrough, a first screw thread around an outer surface thereof, one or more raised portions arranged circumferentially on the outer surface, the raised portions defining a first face surrounding the first substantially tubular member and substantially perpendicular to the outer surface, the first face being directed toward the first screw thread, the first face having a plurality of first projections, each first projection having a first substantially straight portion arranged parallel to the bore of the first substantially tubular member and a first sloping portion, joining an apex of the first projection to a base of an adjacent projection: and a second tubular member having a bore therethrough, a second screw thread around an inner surface thereof, one or more raised portions arranged circumferentially on an outer surface thereof, the raised portions defining a second face surrounding the second tubular member and substantially perpendicular to the outer surface of the second tubular member, the second face being at an end of the second tubular member, the second face having a plurality of second projections, each second projection having a second substantially straight portion arranged parallel to the bore of the second tubular member and a second sloping portion, joining an apex of the second projection to a base of an adjacent projection; wherein the first tubular member slides within the second tubular member, the first and second screw threads mate and on partial engagement of the first and second screw threads, the first and second straight portions can meet to thereby transfer torque when a member is rotated in the direction of the first and second screw threads, wherein the running tool includes one or more first radial outlets arranged circumferentially around the first body, the setting sleeve includes one or more second radial outlets arranged circumferentially around the second body, and in a first position the first and second radial outlets are aligned and fluid can pass radially from the system.

2. The drilling liner system as claimed in claim 1 wherein the running tool includes the first tubular and the setting sleeve includes the second tubular member.

3. The drilling liner system as claimed in claim 1 wherein the bores align to provide a continuous central bore through the system.

4. The drilling liner system as claimed in claim 1 wherein the screw threads are right hand screw threads.

5. The drilling liner system as claimed in claim 1 wherein there are four radial outlets in each body.

6. The drilling liner system as claimed in claim 1 wherein the first position occurs when the first and second screw threads are partially engaged.

7. The drilling liner system as claimed in claim 1 wherein the system further comprises a seal stem, the stem having a substantially cylindrical third body with a third bore therethrough, a third screw thread on an outer surface thereof for engagement to the second screw thread, and a polished end distal to the third screw thread.

8. A method of setting a liner in a well bore, the method comprising the steps;

(a) providing a drilling liner system comprising a running tool having a substantially cylindrical first body and a first bore therethrough, the first body having an end adapted for connection to a drill string, and a setting sleeve having a substantially cylindrical second body and a second bore therethrough, the second body having an end adapted for connection to a liner, wherein the running tool and the setting sleeve couple via a detachable coupling a first substantially tubular member having a bore therethrough a first screw thread around an outer surface thereof, one or more raised portions arranged circumferentially on the outer surface, the raised portions defining a first face surrounding the first substantially tubular member and substantially perpendicular to the outer surface, the first face being directed toward the first screw thread the first face having a plurality of first projections, each first projection having a first substantially straight portion arranged parallel to the bore of the first substantially tubular member and a first sloping portion, joining an apex of the first projection to a base of an adjacent projection, and a second tubular member having a bore therethrough, a second screw thread around an inner surface thereof, one or more raised portions arranged circumferentially on an outer surface thereof, the raised portions defining a second face surrounding the second tubular member and substantially perpendicular to the outer surface of the second tubular member, the second face being at an end of the second tubular member, the second face having a plurality of second projections, each second projection having a second substantially straight portion arranged parallel to the bore of the second tubular member and a second sloping portion, joining an apex of the second projection to a base of an adjacent projection; wherein the first tubular member slides within the second tubular member, the first and second screw threads mate and on partial engagement of the first and second screw threads, the first and second straight portions can meet to thereby transfer torque when a member is rotated in the direction of the first and second screw threads;

(b) connecting the running tool and setting sleeve by engaging the first and second screw threads until the first and second straight portions meet;

(c) connecting the running tool to a drill string and the setting sleeve to a liner;

(d) transmitting torque to the liner by rotating the drill string in a first direction;

(e) cementing the liner in place by introducing cement slurry axially into a central bore of the drilling liner system, to allow the slurry to exit the liner and locate between the liner and the well bore;

(f) rotating the drill string in a reverse direction until the first and second screw threads disengage and shearing shear means when the drill string is rotated in the reverse direction;

(g) removing the running tool from the well bore; and (h) removing an assembly from the well bore through the liner when the system is connected to the liner.

9. The method of setting a liner in a well bore as claimed in claim 8 wherein the method includes the step of rotating and reciprocating the system on the drill string during cementing.

10. A method of setting a liner in a well bore, the method comprising the steps;

(a) providing a drilling liner system comprising a running tool having a substantially cylindrical first body and a first bore therethrough, the first body having an end adapted for connection to a drill string, and a setting sleeve having a substantially cylindrical second body and a second bore therethrough, the second body having an end adapted for connection to a liner, wherein the running tool and the setting sleeve couple via a detachable coupling a first substantially tubular member having a bore therethrough a first screw thread around an outer surface thereof, one or more raised portions arranged circumferentially on the outer surface, the raised portions defining a first face surrounding the first substantially tubular member and substantially perpendicular to the outer surface, the first face being directed toward the first screw thread the first face having a plurality of first projections, each first projection having a first substantially straight portion arranged parallel to the bore of the first substantially tubular member and a first sloping portion, joining an apex of the first projection to a base of an adjacent projection, and a second tubular member having a bore therethrough, a second screw thread around an inner surface thereof, one or more raised portions arranged circumferentially on an outer surface thereof, the raised portions of the second tubular member defining a second face surrounding the second tubular member and substantially perpendicular to the outer surface of the second tubular member, the second face being at an end of the second tubular member, the second face having a plurality of second projections, each second projection having a second substantially straight portion arranged parallel to the bore of the second tubular member and a second sloping portion, joining an apex of the second projection to a base of an adjacent projection; wherein the first tubular member slides within the second tubular member, the first and second screw threads mate and on partial engagement of the first and second screw threads, the first and second straight portions can meet to thereby transfer torque when a member is rotated in the direction of the first and second screw threads;

(b) connecting the running tool and setting sleeve by engaging the first and second screw threads until the first and second straight portions meet;

(c) connecting the running tool to a drill string and the setting sleeve to a liner;

(d) transmitting torque to the liner by rotating the drill string in a first direction;

(e) cementing the liner in place by introducing cement slurry axially into a central bore of the drilling liner system, to allow the slurry to exit the liner and locate between the liner and the well bore;

(f) rotating the drill string in a reverse direction until the screw threads disengage and shearing shear means when the drill string is rotated in the reverse direction;

(g) aligning radial ports of the running tool with radial ports of the setting sleeve to expel fluid from the system; and (h) removing the running tool from the well bore.

11. The method of setting a liner in a well bore as claimed in claim 10 wherein the method includes the step of rotating and reciprocating the system on the drill string during cementing.

12. A method of setting a liner in a well bore, the method comprising the steps;

(a) providing a drilling liner system comprising a running tool having a substantially cylindrical first body and a first bore therethrough, the first body having an end adapted for connection to a drill string, and a setting sleeve having a substantially cylindrical second body and a second bore therethrough, the second body having an end adapted for connection to a liner, wherein the running tool and the setting sleeve couple via a detachable coupling a first substantially tubular member having a bore therethrough a first screw thread around an outer surface thereof, one or more raised portions arranged circumferentially on the outer surface, the raised portions defining a first face surrounding the first substantially tubular member and substantially perpendicular to the outer surface, the first face being directed toward the first screw thread the first face having a plurality of first projections, each first projection having a first substantially straight portion arranged parallel to the bore of the first substantially tubular member and a first sloping portion, joining an apex of the first projection to a base of an adjacent projection, and a second tubular member having a bore therethrough, a second screw thread around an inner surface thereof, one or more raised portions arranged circumferentially on an outer surface thereof, the raised portions of the second tubular member defining a second face surrounding the second tubular member and substantially perpendicular to the outer surface, the second face being at an end of the second tubular member, the second face having a plurality of second projections, each second projection having a second substantially straight portion arranged parallel to the bore of the second tubular member and a second sloping portion, joining an apex of the second projection to a base of an adjacent projection; wherein the first tubular member slides within the second tubular member, the first and second screw threads mate and on partial engagement of the first and second screw threads, the first and second straight portions can meet to thereby transfer torque when a member is rotated in the direction of the first and second screw threads;

(b) connecting the running tool and setting sleeve by engaging the screw threads until the first and second straight portions meet;

(c) connecting the running tool to a drill string and the setting sleeve to a liner;

(d) transmitting torque to the liner by rotating the drill string in a first direction;

(e) following rotation in the first direction, noting a first circulation pressure in the well bore;

(f) applying liner weight to a bottom of the well bore and partly releasing the running tool from the setting sleeve to shear the shear screws and align radial ports of the running tool with radial ports of the setting sleeve;

(g) confirming that circulation pressure has dropped from the first circulation pressure;

(h) on pressure loss rotating the drill string until the straight portions meet;

(i) confirming circulation pressure has returned to the first circulation pressure;

(j) cementing the liner in place by introducing cement slurry axially into a central bore of the drilling liner system, to allow the slurry to exit the liner and locate between the liner and the well bore;

(k) rotating the drill string in a reverse direction until the first and second screw threads disengage; and (l) removing the running tool from the well bore.

13. The method of setting a liner in a well bore as claimed in claim 12 wherein the method includes the step of rotating and reciprocating the system on the drill string during cementing.

* * * * *